United States Patent [19]

Hewson

[11] Patent Number: 4,492,069

[45] Date of Patent: Jan. 8, 1985

[54] APPARATUS AND METHOD FOR FLATTENING A POUCH

[75] Inventor: Gordon Hewson, Cobourg, Canada

[73] Assignee: General Foods Inc., Ontario, Canada

[21] Appl. No.: 470,411

[22] Filed: Feb. 28, 1983

[51] Int. Cl.[3] ..... B65B 1/24; B65B 13/20

[52] U.S. Cl. ..... 53/436; 53/526; 100/233; 100/291

[58] Field of Search ..... 53/436, 526, 527, 113; 100/151, 233, 291

[56] References Cited

U.S. PATENT DOCUMENTS

| | | | |
|---|---|---|---|
| 774,530 | 11/1904 | Oppenheim | 100/118 |
| 780,033 | 1/1905 | Hachmann | 100/154 |
| 1,976,691 | 10/1934 | Rambold | 53/526 |
| 2,478,505 | 8/1949 | Salfisberg | 53/526 |
| 2,618,015 | 11/1952 | Lloyd | 100/151 |
| 2,675,053 | 4/1954 | Clemens | 100/151 |
| 2,682,216 | 6/1954 | Shields | 53/526 |
| 2,837,882 | 6/1958 | Hull | 53/124 |
| 2,856,741 | 10/1958 | Hartman | 53/526 |
| 2,941,676 | 6/1960 | Harker | 53/526 |
| 3,645,198 | 2/1972 | Field | 53/526 |
| 3,932,983 | 1/1976 | Hughes | 53/526 |
| 4,411,122 | 10/1983 | Cornish et al. | 53/526 |

FOREIGN PATENT DOCUMENTS

| | | | |
|---|---|---|---|
| 2375098 | 8/1978 | France | 53/526 |

*Primary Examiner*—Francis S. Husar
*Assistant Examiner*—J. M. Griffin
*Attorney, Agent, or Firm*—Thomas A. Marcoux; Thomas R. Savoie; Daniel J. Donovan

[57] ABSTRACT

In an apparatus and method for flattening a sealed pouch containing a solid flowable product, the pouch is inclined upwardly with the end thereof having a disproportionately larger amount of product located uppermost. A bucket device supports the pouch and opposes a plate, resiliently exerting a pressure against the pouch, creating an air pocket at the lower most end of the pouch, after which the product flows downwardly to that end. A car assembly movable along a conveyor has a lower part mounted on the conveyor and an upper part pivotally connected to the lower part which is raised by a cam, and which includes the bucket device.

12 Claims, 12 Drawing Figures

APPARATUS AND METHOD FOR FLATTENING A POUCH

BACKGROUND OF THE INVENTION

This invention relates to the manufacture and handling of sealed, generally flat packages, and in particular it relates to an improved apparatus and method for flattening such packages.

Packages containing powdered or granular material are generally filled from above, in an upright condition, causing a majority of the product to settle to the bottom of the package, rendering that end much thicker than the top end. However, for economical placement of a group of these packages into a larger carton or the like, it is necessary that the individual packages be substantially flat. Flattening of the individual packages requires manipulating the packages so as to shift a portion of the product away from the thicker end and towards the thinner end of the package.

Heretofore, flattening of the individual packages has been carried out by an arrangement of the type as shown in the Field U.S. Pat. No. 3,645,198, according to which the individual packages are transported in a horizontal plane between upper and lower opposed plates, which plates exert a uniform pressure against opposed surfaces of the individual packages.

However, while these prior arrangements have proved satisfactory for certain products which flow more freely, such as agglomerations, they do not cause sufficient movement within the individual packages when the product is a more fine powder, especially a sugar based product. An apparatus of this type will have a tendency to compress the powdered material located at the thicker end of the package without necessarily causing any significant portion thereof to shift within the package to the opposite, thinner end.

Hence, there exists a need for a new and improved arrangement for flattening out packages containing solid flowable materials such as powdered or granular materials, which arrangement will be more effective for all types of solid flowable materials, especially materials which are not easily shiftable within the package, such as fine powdered products, for example, sugar based powdered products.

SUMMARY OF THE INVENTION

Hence, it is an object of the present invention to provide a new and improved apparatus and method for flattening sealed packages, also referred to as products, containing solid flowable materials, which apparatus and method are effective even on materials which flow only with great difficulty.

This object is achieved, in accordance with the present invention, by providing an apparatus and method according to which the individual packages, or pouches, are inclined with the thicker portion uppermost. In cooperation therewith, uniform pressure is applied to opposing sides of the package, thereby pressurizing the gaseous medium (usually air) within the package, creating an enlarged gas space at the lower (initially thinner) end of the package. With the package thus positioned, and with the pressure thus created, the solid material then flows toward the space at the initially thinner end of the package. The timing and magnitude of the pressure, taken together with the angle of inclination of the package, are carefully selected so as to result in that amount of product flow which will result in optimum flattening of the package.

Preferably the last portion of travel of the opposed plates against the sides of the package is resiliently yieldable, thus providing greater control over the applied pressure and preventing crushing of the product.

In a preferred embodiment of the apparatus of the present invention, individual bucket means adapted to receive a package are mounted for movement along a conveyor and comprise upper and lower parts. The lower part remains attached to the conveyor while the upper part, containing the bucket device itself, is pivotable upwardly relative to the lower part, first under the action of a cam track and then under the action of a spring means, raising the package with the thicker portion uppermost against a fixed plate which engages the package during a portion of the conveyor travel therepast.

Preferably the upper part includes a cam follower which positively engages the cam track and which is resiliently movable, under the action of a spring means, towards and away from the bucket device itself. This resilient connection between the cam follower and the bucket device provides the resilient yielding movement referred to above during the last portion of movement of the package towards the fixed plate.

In accordance with the method of the present invention, a package of the type described is flattened by first positioning the package in an inclined position with the thicker portion thereof uppermost and then exerting a uniform pressure against both sides of the package, inflating the package and creating a space at the lower, originally thinner end thereof. With the package in this condition, the product is caused to flow downwardly from the originally thicker end to the originally thinner end, thereby tending to flatten the package. By proper selection of the angle of inclination and the magnitude and duration of the applied pressure, the method will result in a package having optimum flatness.

Hence, it is an object of the present invention to provide a new and improved apparatus for flattening packages, especially packages having material such as fine powders or sugar based powders or granules which do not easily flow within the package.

It is still another object of the present invention to provide an apparatus for flattening packages of the type described, which apparatus comprises a bucket device movable along a conveyor and adapted to be inclined upwardly with the thicker portion of the package uppermost, and to engage a fixed plate mounted along the conveyor, such that the bucket device and the fixed plate exert a uniform pressure on the package, increasing the pressure therein and creating a space at the lower end thereof, into which the product flows.

It is another object of the present invention to provide a new and improved method for flattening a package, according to which method the package is placed at an inclined position with the thicker portion uppermost, and according to which pressure is uniformly applied to opposing faces of the package, increasing the pressure therein and creating a space at the lower end thereof permitting product to flow from the thicker end of the package downwardly to the thinner end of the package, thereby resulting in a package of optimum flatness.

It is still another object of the present invention to provide a new and improved method, as described above, wherein, by proper selection of the angle of inclination and the magnitude and duration of the pressure, the product flow from the upper end of the package to the lower end thereof can be carefully controlled so as to result in optimum flatness of the package.

These and other objects of the present invention will become more apparent from the detailed description to follow, taken together with the accompanying drawings.

BRIEF DESCRIPTION OF THE DRAWINGS

There follows a detailed description of preferred embodiments of the present invention, which are to be read together with the accompanying drawings which are provided only for purposes of illustration, and in which.

DETAILED DESCRIPTION OF THE PREFERRED EMBODIMENTS

Referring now to the figures, like elements are represented by like numerals throughout the several views.

Figure 1:
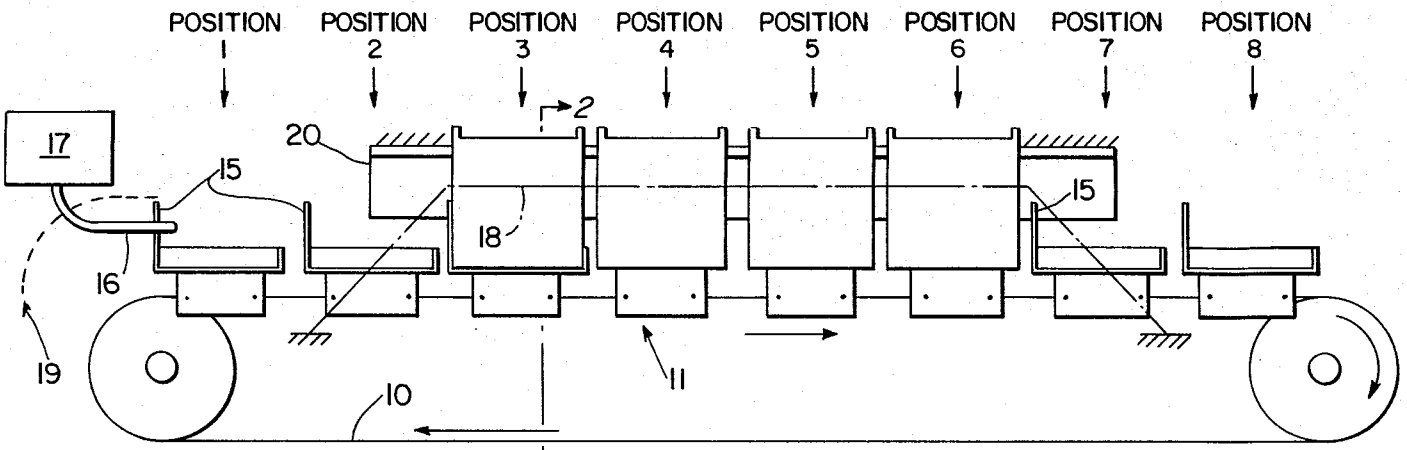
FIG. 1 is a schematic side elevational view of an apparatus including the features of the present invention.

Referring to FIG. 1, there is shown a conveyor having an endless carrier chain having an upper, operative run and a lower return run in the direction as indicated by the arrows. Although the conveyor includes a plurality of car assemblies 11 mounted equidistantly along the entire length of the conveyor chain 10, only those car assemblies presently located on the upper, operative run are illustrated, the remaining car assemblies having been deleted for purposes of clarity.

Figure 2:
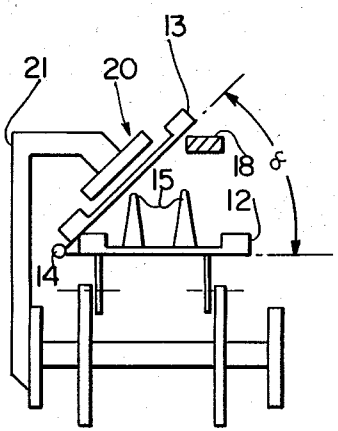
FIG. 2 is a schematic, sectional view taken along line 2—2 of FIG. 1.

Referring to FIG. 2, each car assembly 11 is made up of two primary parts including a lower part 12 which remains in a horizontal plane at all times during its travel along the operative run of the conveyor and an upper part 13 which is normally also in a horizontal position against the lower part 12, but which is raised upwardly about pivot axis 14 by cooperation between the upper part 13 and a fixed cam track 18. The full extent of fixed cam tract 18 is shown schematically in FIG. 1.

Figure 10:
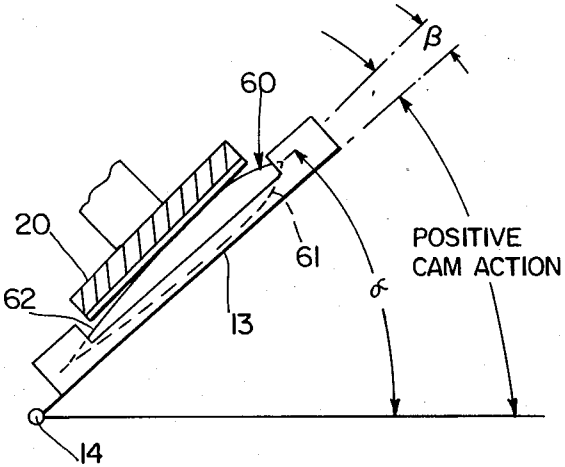
FIGS. 9–11 are enlarged schematic views illustrating the method of operation of the present invention.

Referring again to FIG. 1, positions 1–8 of the operative run are designated. The individual packages to be flattened are placed onto the conveyor, one onto each car assembly. Normally, the packages can be loaded onto the conveyor at position 2. However, in other instances the apparatus may include a scale 17. In this case the finished closed package would slide down ramp 16 which is made up of a plurality of parallel rods spaced apart from each other. In this case as each car assembly 11 revolves about the left-hand pulley of the conveyor arrangement, prongs 15 attached to the lower part 12 would follow the arcuate path designated as 19 in FIG. 1, whereupon the prongs 15 would move between the rods of slide 16, urging the product forwardly into its respective car assembly. After position 2, the upper part 13, with the package contained therein, with the thicker portion of the package toward the right-hand side (as viewed in FIG. 2) would then engage cam surface 18, causing the upper part 13 to turn upwardly about pivot axis 14, and this condition would continue through positions 3–6. As each upper part 13 rides along cam surface 18, the said part 13 cooperates with a fixed pressure plate 20 to exert pressure uniformly against the sides of the package contained therein. Referring momentarily to FIG. 10, cam 18 would urge the upper part 13 upwardly to an angle $\alpha$. However, because of a resilient means to be described in greater detail below, the upper part 13 is free to retreat against this resilient force through the angle indicated as $\beta$.

This elevation of incline is designed to be beyond the angle of repose of the solid flowable material contained within the package. Hence, when the pressure exerted by upper part 13 and fixed plate 20 increase the pressure within the package, a void is created at the lower end thereof, i.e. the initially thinner end which is closest to the pivot axis 14, whereupon the solid flowable material within the package now flows away from the initially thicker upper end towards the initially thinner lower end, thereby flattening the package.

Figure 3:
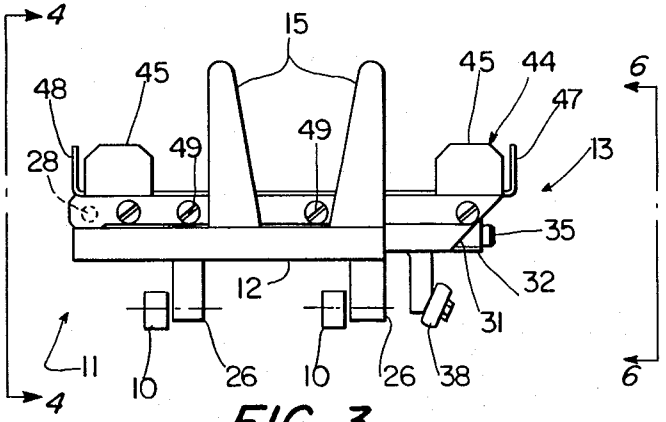
FIG. 3 is an enlarged side elevational view of a car assembly of the present invention.
Figure 4:
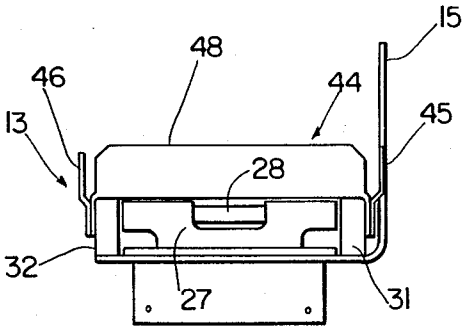
FIG. 4 is a side elevational view from the left-hand end of FIG. 3.
Figure 5:
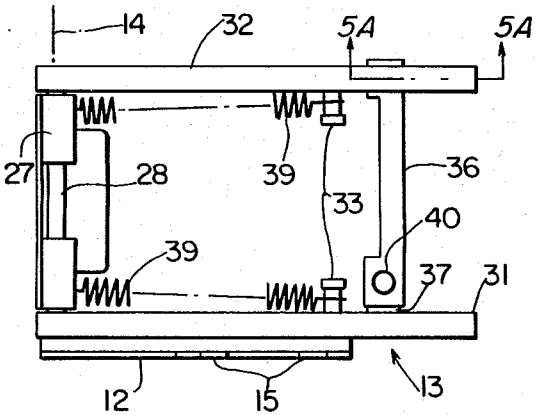
FIG. 5 is a plan view of FIG. 3 with the uppermost element of the assembly removed for purposes of clarity.

The car assembly is shown in greater detail in FIGS. 3–6. As shown therein, each car assembly includes a lower part 12 connected to the conveyor 10 at 26 for movement with the conveyor. Each lower part 12 includes a pair of raised prongs 15, as described and illustrated with respect to FIGS. 1 and 2, the primary purpose of these prongs 15 being to guide the product from the scale slide onto a car assembly at position 1. At its left-hand end (as illustrated in FIGS. 3 and 5) there is fixed to the lower part 12 a pivot pin casing 27 which receives therein an elongated pivot pin 28.

The upper part 13 comprises first and second side frames 31 and 32 which are shown in each of FIGS. 3, 4, 5 and 6, but are best shown in FIG. 5, wherein the bucket means mounted on the side frames has been eliminated for purposes of illustration. Referring to FIG. 5 the side frames are pivoted at their left-hand end to the pivot pin 28. A pair of knobs 33 are connected to and extend inwardly from the side frames 31 and 32. Tension springs 39 connect each of these knobs to the pin casing 27. Springs 39 tend to pull the upper part 13 downwardly against the lower part 12.

Figure 6:
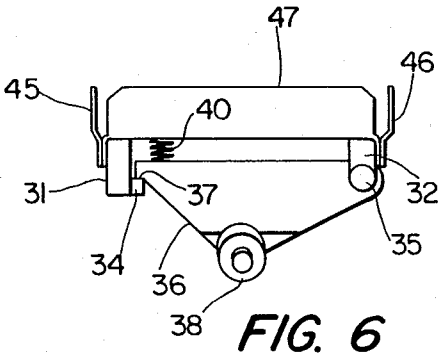
FIG. 6 is a side elevational view taken from the right-hand side of FIG. 3, with the lower portion of the assembly removed for purposes of clarity.
Figure 5A:
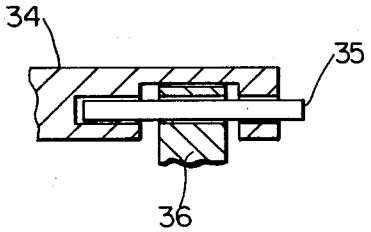
FIG. 5A is an enlarged, partially cross-sectional view taken along line 5A—5A of FIG. 5.

A cross member 36 is pivotally connected to side frame 32 by means of a pin 35, as best illustrated in FIG. 5A. Referring to FIG. 6, at its opposite end cross member 36 has a stop surface 37 which rests against a stop ledge 34 on the first side frame 31 and is resiliently urged to that condition by coil spring 40 which at its lower end rests in a suitable matching recess in the upper surface of cross member 36. At its lower end, cross member 36 includes a cam follower roller 38 which cooperates with fixed cam surface 18.

An upper bucket device 44 has a flat bottom surface against which the package rests. The plate is bent downwardly along side frames 31 and 32, to which it is attached by means of screws 49 shown in FIG. 3, after which it is bent upwardly on its sides as well as at the two ends to form the package retaining "bucket". As shown in the drawings, the bucket device includes upstream sides 45, downstream sides 46, and end wall 47 at the end adapted to be raised relative to the lower part 12 and an opposite end wall 48 in the vicinity of the pivot pin 28. The two raised side walls 45, as well as the two side walls 46, are spaced from each other a sufficient distance such that they do not interfere with the fixed pressure plate when the upper part 13 is raised about the axis of pivot pin 28.

FIG. 6 illustrates the relative positions of cross member 36 and bucket device 44 at their maximum distance from each other with the spring 40 urging stop surface 36 against stop ledge 34. However, when, during the operation of the apparatus a package mounted in bucket device 44 engages the fixed pressure plate 20 while the cam surface 18 continues to urge the roller 38, and hence the cross member 36, to a higher level, then cross member 36 will move off of ledge 34, opposing spring 40 as the cross member 36 pivots around pin 35. This movement provides the resilient yieldable force of bucket device 44 against the fixed pressure plate as the car assembly moves through positions 3–6 of FIG. 1.

Figure 8:
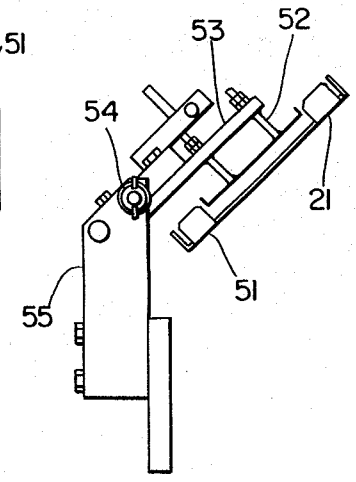
FIG. 8 is a side elevational view, taken from the right-hand end of FIG. 7.
Figure 7:
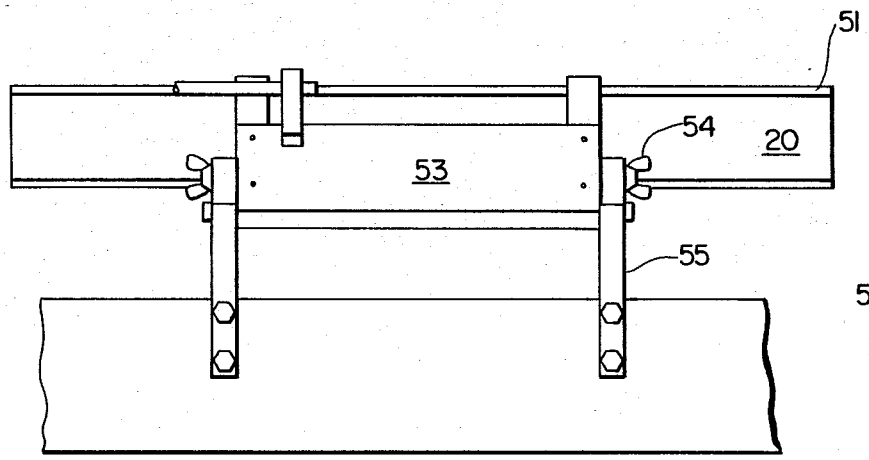
FIG. 7 is a rear elevational view of the fixed plate which appears in FIGS. 1 and 2.

FIGS. 7 and 8 illustrate the fixed pressure plate in greater detail. The pressure plate itself, shown at 51, is attached to connecting rods 52 which in turn are connected to a rear mounting plate 53. The latter is connected to a post 55 along a pivot axis 54 which permits changing the angle of the pressure plate 51 about the axis of pivot connection 54. It would be possible to mount the fixed pressure plate 51 such that it also exerted a resiliently yieldable force rather than a fixed force against the package. However, in operation it has been found suitable to control the pressure on the package by making one of the pressure surfaces fixed, namely the pressure plate 51, and the other surface, bucket 44, resiliently yieldable.

The operation of the apparatus, and the method of the invention will now be described with reference to all of the figures, especially FIGS. 1, 2, 9, 10 and 11.

The packages to be flattened have generally been filled while in an upright position so that the solid flowable product, i.e. granular or powdered product, has fallen to the bottom of the package. The package is sealed shut in this condition, whereupon one end of the package is relatively thick, containing a disproportionately larger portion of the product, while the opposite end is much thinner, either being empty or otherwise containing a disproportionately lesser portion of the product. The package is then mounted onto a car assembly 11 either at position 1 if the package has been removed directly from the slide 16 of scale 17 or at position 2 if the packages are loaded without first passing through scale 17. The package, in this condition, is shown schematically in FIG. 9 at 60, the enlarged, thicker end shown at 61 and the thinner end shown at 62. It is noted in FIG. 9 that the thinner end 62 is closest to the pivot axis 14.

Figure 11:
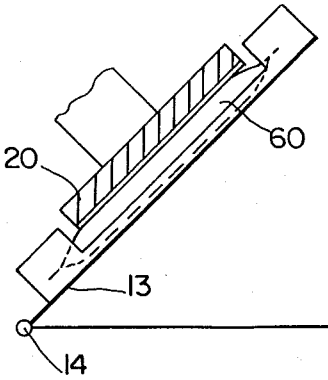
Figure 9:
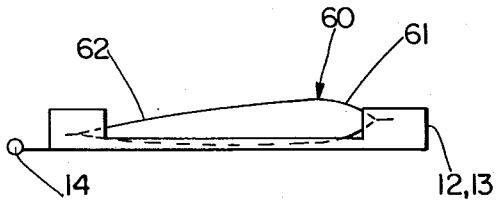

As the car assembly rides up the inclined portion of cam surface 18, cam follower 38 raises the upper car part 13 through the angle $\alpha$, as shown in FIG. 10. However, because of the resilient connection 40 between cross member 36 and bucket device 44, the bucket device is free to retreat resiliently through the angle $\beta$. This permits greater control over the applied pressure and prevents crushing of the product. At the stage as shown in FIG. 10, the upper end 61 is still somewhat thicker. However, at this stage the opposed surfaces of 44 and 20 exert a pressure which is felt inside of the package 60, creating a gas pocket at the lower end 62. Since the package has been inclined beyond the angle of repose of the solid flowable material therein, the material now flows downwardly to fill that gaseous space. By properly controlling the pressure exerted by the opposed surfaces of 44 and 20, the angle of inclination and the duration that the pressure is applied, the flow of product can be carefully controlled until just enough has flowed down the product from end 61 to end 62 for the package to be essentially flattened, as shown in FIG. 11.

Thereafter, the roller 38 of the cross piece 36 reaches the downwardly inclined portion of cam surface 18, first permitting separation of the bucket device 44 from the cross member 36 under the action of spring 40, and then complete separation of the upper part 13 from the fixed plate 20 as the upper part 13 is pulled downwardly against the lower part 12 under the action of the springs 39. Finally, the flattened packages are removed at station 8.

As one example, in one particular application of the invention which is used to flatten pouches containing 92 grams of a sugar based package of crystals and having outer dimensions of approximately four inches by six inches, the spacing between the elements 36 and 44 moves from three-fourths of an inch when ledge 34 receives stop surface 37 to a minimum spacing of seven-sixteenths of an inch upon compression of the spring 40.

Although the invention has been described in considerable detail with respect to preferred embodiments thereof, it will be apparent that the invention is capable of numerous modifications and variations, apparent to those skilled in the art, without departing from the spirit and scope of the invention, as defined in the claims.

I claim:

1. An apparatus for flattening a pouch of a flexible material containing therein a solid flowable product in a gaseous medium, comprising:

bucket means for mounting a pouch with a first pouch end containing a disproportionately large portion of the product located at a first end of the bucket means, and a second pouch end which contains a disproportionately lesser portion of the product, mounted at the opposite, second end of the bucket means, tilting means operatively connected to said bucket means for tilting the first end of the bucket means upwardly to place the pouch in an inclined position with the first pouch end raised, and pressure means located above said bucket means for exerting a pressure against the sides of the pouch, while it is in its inclined position, to increase the pressure within the pouch, creating a gas space at the second end, and thereby permitting a sufficient volume of the solid flowable product to flow down toward the second end to generally even out the solid flowable product and hence generally flatten the pouch itself.

2. An apparatus according to claim 1, including a conveyor, a car assembly mounted on the conveyor and having a lower car part attached to the conveyor for movement therealong, and said bucket means comprising an upper car part pivotally attached to the lower car part for pivotable upward movement relative thereto, and raising means for raising the upper car part about said pivot axis, and a fixed plate opposing the bucket means, in its raised position, to form with the bucket means the said pressure means.

3. An apparatus according to claim 2, including resilient means acting between said raising means and said bucket means, such that the final movement of the bucket means towards the fixed plate is resiliently yieldable.

4. An apparatus according to claim 3, said raising means comprising a cam track, and including a cam follower means connected to the bucket means, and including spring means permitting the bucket means to move resiliently toward the cam follower means.

5. An apparatus according to claim 4, said conveyor being an endless conveyor having a plurality of car assemblies mounted thereon, an upper operative run and a lower return run, the upper run including a loading position followed by a plurality of pouch pressing positions, and an unloading position, a cam track fixedly positioned to be engaged by the cam follower ahd having a raised part to cause the bucket means to pivot upwardly between said loading and unloading positions, and said fixed plate opposing the raised part of the cam track.

6. An apparatus according to claim 1, including a plurality of car assemblies for successively carrying a plurality of pouches into operative association with the tilting means and the pressure means, each car assembly comprising a lower car part, and the bucket means being an upper car part pivotally attached to the lower car part for pivotable movement upwardly relative thereto.

7. An apparatus according to claim 6, said upper car part including a cam follower adapted to engage a cam for inclining upwardly the upper car part relative to the lower car part, said cam follower being resiliently connected to the bucket means such that the final movements of the bucket means, under the action of the pressure means, is resiliently yieldable.

8. An apparatus according to claim 7, the upper car part being pivotable relative to the lower car part about a first pivot axis parallel to the direction of travel of the car assemblies, and the cam follower being pivotally connected to the bucket means for pivotable movement about an axis perpendicular to said direction of travel, and the resilient connection being a spring means opposing the pivotal movement of the bucket means relative to the cam follower.

9. An apparatus according to claim 1, said tilting and pressure means including resilient means for making the final movements of the pressure means against the sides of the pouch resiliently yieldable.

10. A method of flattening a pouch of a flexible material containing solid flowable product in a gaseous medium by evening out the solid flowable product within the pouch, comprising the steps of:

positioning generally horizontally a generally flat pouch having a disproportionately large portion of its solid flowable product located toward a first end of the pouch and a disproportionately lesser portion of the product located at a second end of the pouch, tilting the first end of the pouch upwardly while concurrently applying a pressure uniformly against the opposed side surfaces of the pouch, to slightly increase the pressure within the pouch, and to form a gas pocket in the pouch at the second end thereof, and continuing to exert the pressure until a sufficient portion of the solid flowable product at the first end runs down toward the second end to essentially even out the solid flowable product, and hence generally flatten the pouch itself.

11. A method according to claim 10, wherein the last stage of exerting the pressure against the pouch is resiliently yieldable.

12. A method according to claim 10, said positioning step including positioning the pouch on a bucket device movable along an elongated path and engaging a cam which tilts the bucket device upwardly about a pivot axis parallel to the path against a fixed plate surface which also extends parallel to the path, such that the pressure is exerted on the pouch by the opposed bucket device and plate.

* * * * *